United States Patent [19]

Kosuge

[11] 4,004,385

[45] Jan. 25, 1977

[54] BUILDING STRUCTURE USING CONCRETE BLOCKS

[76] Inventor: Momotoshi Kosuge, No. 834-9, Kitaishigaki, Beppu, Oita, Japan

[22] Filed: Apr. 10, 1974

[21] Appl. No.: 459,725

[30] Foreign Application Priority Data

| | | |
|---|---|---|
| Apr. 17, 1973 | Japan | 48-46207[U] |
| May 8, 1973 | Japan | 48-53905[U] |
| Apr. 26, 1973 | Japan | 48-50473[U] |

[52] U.S. Cl. ..... 52/259; 52/145; 52/405; 52/407; 52/439; 52/609

[51] Int. Cl.[2] ..... E04B 1/82; E04B 2/02

[58] Field of Search ..... 52/145, 259, 405, 439, 52/505, 407, 609, 590, 604, 421, 436

[56] References Cited

UNITED STATES PATENTS

| | | | |
|---|---|---|---|
| 1,175,376 | 3/1916 | Patee | 52/407 |
| 2,058,285 | 10/1936 | Amescua | 52/439 |
| 2,176,986 | 10/1939 | Briscoe | 52/439 X |
| 2,352,338 | 6/1944 | Muirhead | 52/439 |
| 3,001,602 | 9/1961 | Taylor | 52/145 |
| 3,204,381 | 9/1965 | Perreton | 52/407 X |
| 3,222,830 | 12/1965 | Ivany | 52/259 X |
| 3,292,331 | 12/1966 | Sams | 52/405 |
| 3,318,062 | 5/1967 | Grants | 52/407 X |
| 3,546,833 | 12/1970 | Perreton | 52/405 |
| 3,717,967 | 2/1973 | Wood | 52/259 |
| 3,885,363 | 5/1975 | Whitley | 52/405 X |

FOREIGN PATENTS OR APPLICATIONS

| | | | |
|---|---|---|---|
| 138,278 | 8/1950 | Australia | 52/439 |
| 1,002,001 | 10/1951 | France | 52/505 |
| 921,276 | 5/1947 | France | 52/421 |
| 770,067 | 1/1934 | France | 52/259 |
| 374,408 | 1/1907 | France | 52/439 |
| 1,082,424 | 12/1954 | France | 52/609 |
| 506,271 | 12/1954 | Italy | 52/609 |
| 491,463 | 3/1954 | Italy | 52/259 |
| 79,363 | 8/1949 | Norway | 52/436 |
| 576,935 | 4/1946 | United Kingdom | 52/439 |

*Primary Examiner*—Price C. Faw, Jr.
*Assistant Examiner*—Leslie Braun
*Attorney, Agent, or Firm*—Armstrong, Nikaido & Wegner

[57] ABSTRACT

Lightweight building structures constructed by assembling a plurality of building blocks in contiguous end to end relationship. The blocks have spaced apart and parallel opposite longitudinal walls and opposite transverse members integrally connecting said walls so as to define a substantially rectangular inner space. The top of the transverse members of at least a portion of the blocks are at a lower level than the tops of the longitudinal walls so that horizontally extending reinforcing bars may be positioned therein. Vertically extending reinforcing bars which may be surrounded by reinforcing loops are also positioned within the inner spaces defined by the contiguous blocks. Mortar is charged to the inner spaces defined by contiguous blocks to unite the blocks and reinforcing members. V-shaped vertical edges are provided on the longitudinal walls of a block to provide stronger joints between blocks. Blocks having longitudinal walls of different lengths and flat vertical edges are used to provide L-shaped, T-shaped and cross-shaped corners. In certain embodiments of the building structures, sound or heat insulating materials are positioned within the inner rectangular spaces to provide sound and heat insulating properties.

10 Claims, 20 Drawing Figures

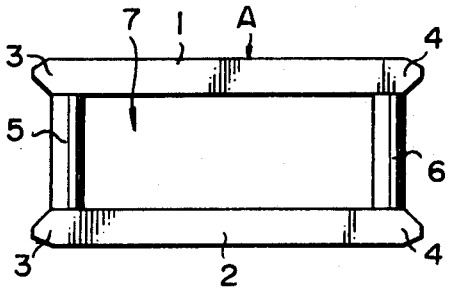
FIG. 1
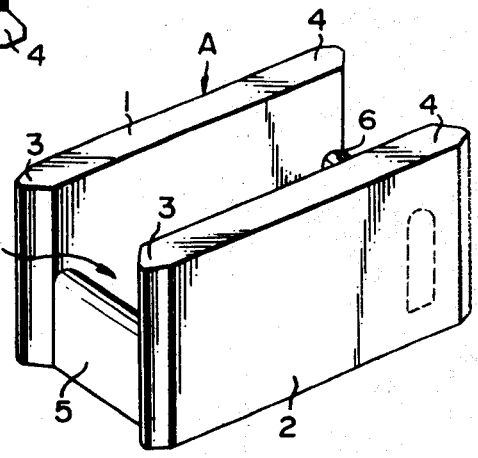
FIG. 2
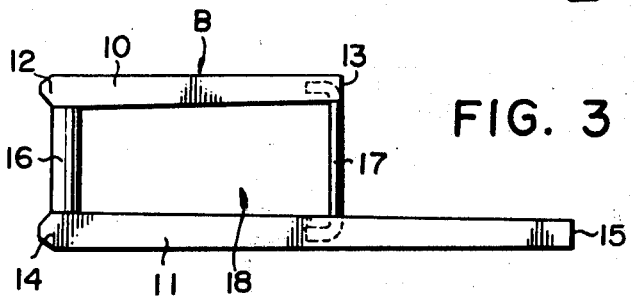
FIG. 3
FIG. 4
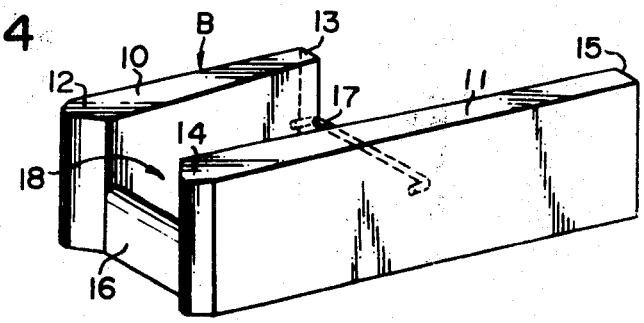

BUILDING STRUCTURE USING CONCRETE BLOCKS

This invention relates to concrete blocks for construction and building structures constructed by using these concrete blocks. An object of the invention is to provide concrete blocks which are quake resistant, sound and heat insulating, fire-proof and moisture-proof. Another object of the invention is to provide a building structure such as walls and houses by suitably combining these blocks.

The prior-art building structures constructed by using concrete blocks are subject to limitation concerning the wall weight and inevitably have a smaller area for the inlet or outlet openings or windows, so that the inside is rather dark. For example, in case of a three-story building with each room having a floor space of 60 $m^2$, almost no window can be provided in the first story. Therefore, the wall-type structure or the reinforced concrete structure was used in the past in preference to the concrete block structure, despite the considerable difficulty in construction works and the necessity for building a temporary mold. So far, while various construction methods for forming L-shaped, T-shaped and cross-shaped corners were proposed, there still remains some room for improvement regarding the quake resistant, sound and heat insulation, and the reduction in the wall weight.

Also, since the reinforced concrete block structure and L-shaped concrete frame structure used in the usual building structure have to widthstand horizontal forces acting in mutually perpendicular directions, and wall weight can not be reduced, it is not easy to construct a comfortable housing.

According to the invention, concrete blocks are combined together into L-shaped, T-shaped or cross-shaped juncture sections provide a rigid wall capable of withstanding biaxial horizontal forces. Thus it is possible to construct a building structure without using temporary mold or web cells and reinforce the pillar portions of the structure by suitably incorporating reinforcing bars. Particularly, since L-shaped and T-shaped corners more likely to be subject to external forces are formed by assembling concrete blocks and uniting them by charging mortar, it is possible to provide a strong building structure consisting of only the blocks without limitation on the wall weight in the reinforced concrete structure and free from mutual shift of the individual blocks.

BRIEF DESCRIPTION OF THE DRAWING

FIG. 1 is a plan view of block A.

FIG. 2 is a perspective view, partly broken away, of the same.

FIG. 3 is a plan view of block B.

FIG. 4 is a perspective view, partly broken away, of the same.

Some embodiments of the invention will now be described, but various other building structures can be formed by suitably combining the concrete blocks used in these embodiments.

EMBODIMENT 1

Quake resisting concrete blocks and building structures constructed with these blocks.

Quake resisting concrete blocks shown in FIGS. 1–10 and the building structure constructed with these blocks.

Figure 5:
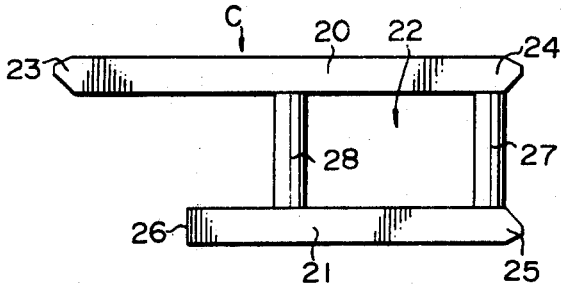
FIG. 5 is a plan view of block C.
Figure 6:
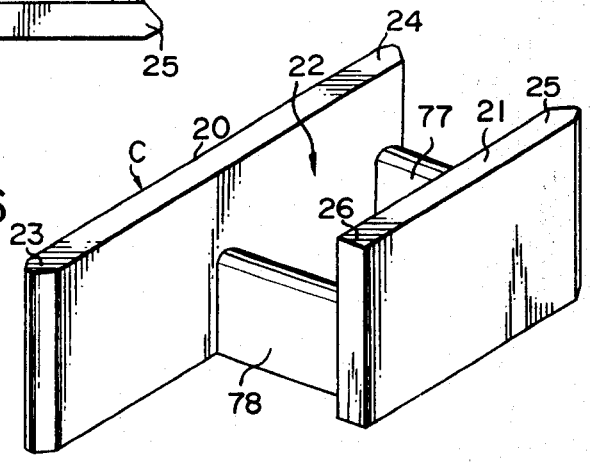
FIG. 6 is a perspective view of the same.
Figure 7:
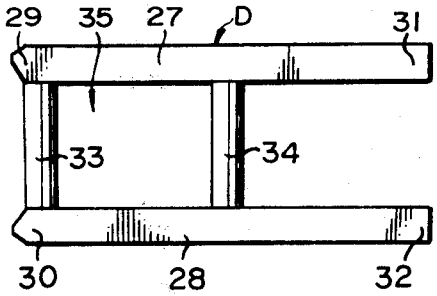
FIG. 7 is a plan of block D.
Figure 8:
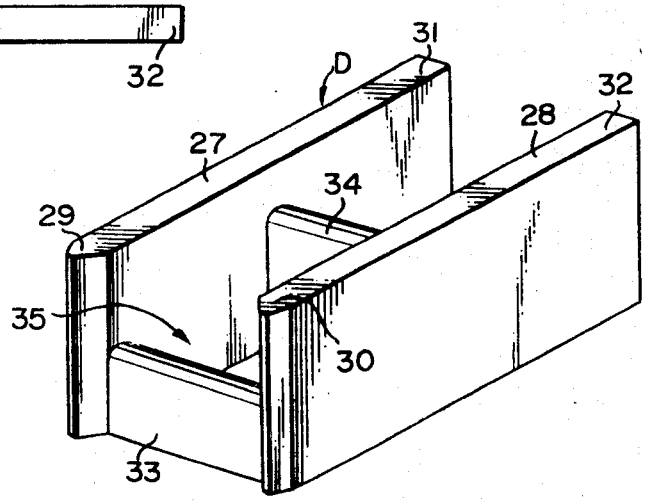
FIG. 8 is a perspective view of the same.
Figure 9:
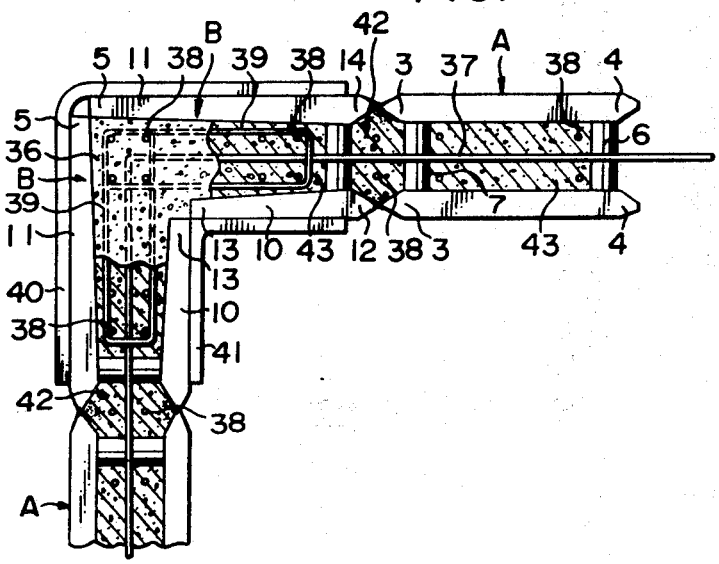
FIG. 9 is a plan view, partly broken away showing a wall structure with an L-shaped corner portion formed of the blocks B and linear wall portions formed by using blocks A.
Figure 10:
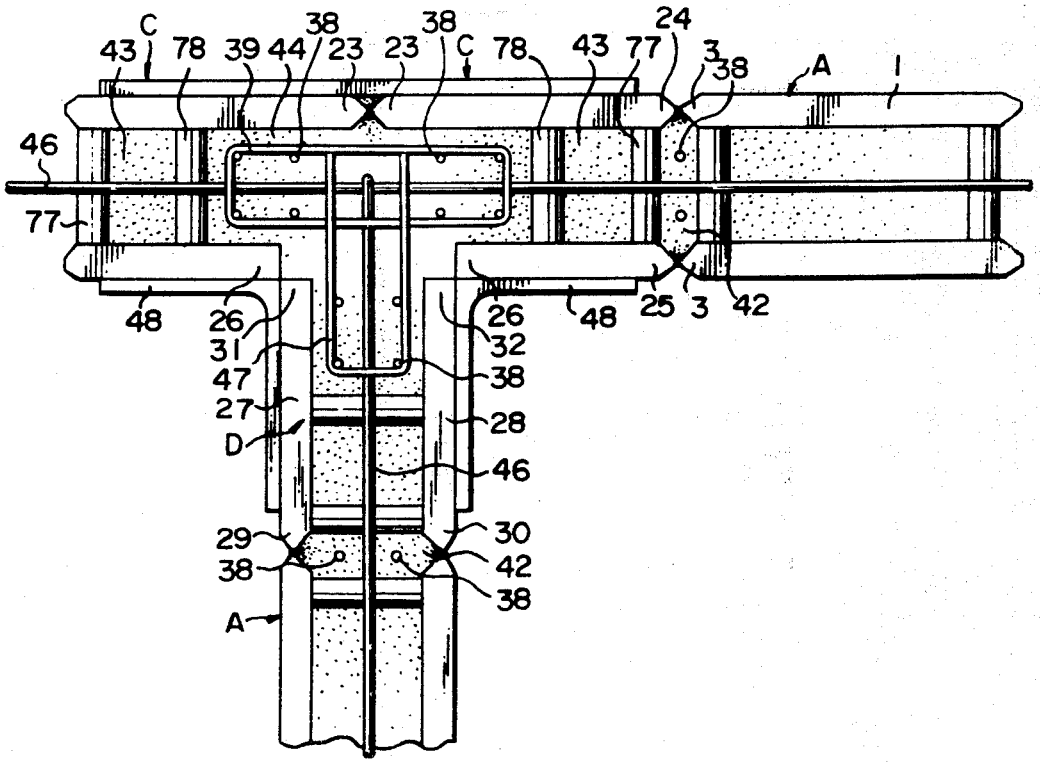
FIG. 10 is a plan view, partly broken away, and showing a wall structure with a T-shaped corner portion formed by using blocks C and D and linear wall portions formed by using blocks A.

FIGS. 1 and 2 show a block A for forming a straight wall, FIGS. 3 to 6 show blocks B and C for forming the corners, and FIGS. 7 and 8 show a block D for forming a wall for the neighboring chamber or a partition wall. FIGS. 9 and 10 show the typical walls constructed by the above concrete blocks.

The concrete block A shown in FIGS. 1 and 2 and used for forming a straight wall comprises two rectangular side boards 1 and 2 spaced from and in parallel with each other, each having flat top and bottom edges and V-shaped edges 3 and 4. These side boards are connected together by two connecting members 5, 6 in a quadrangle having the hollow inner space 7, the connecting members 5 and 6 having a height smaller than that of the boards 1 and 2. The widths of both slanted surfaces of the V-shaped edge may be equal to each other, but the width of the inner slanted surface may also be larger than that of the outer slanted surface, so that a larger amount of mortar can be charged to increase the strength of the juncture portions between the adjacent blocks.

The concrete block B shown in FIGS. 3 and 4 and used for forming a corner of an L shape has two rectangular boards 10 and 11. The former boards 10 has an inner surface inclined relative to an outer surface, and in provided with a flat edge 13 and a edge V-shaped edge 12. The board 11 is about twice longer than the board 10. It has an inner surface inclined relative to an outer surface, and is provided with a flat edge 15, and a V-shaped edge 14, as in the opposite board 10. These boards 10, 11 are placed in parallel and with the inner inclined surfaces facing to each other and connected with connecting members 16, 17 each having a lower height than that of the board 10 or 11. The connecting member 16 connects the boards 10 and 11 at portions thereof adjacent to the V-shaped edges, while the connecting member 17 connects the board 10 at a portion thereof adjacent to the flat edge and the board 11 at an intermediate portion thereof, for defining a trapezoidal inner space 18. With the block having the trapezoidal space 18 as above, a larger quantity of mortar can be charged than in the case of the ordinary block having a rectangular space, so that the strength of the wall joint can be increased and the boards can be made more resistant to distortion.

The concrete block C shown in FIGS. 5 and 6 is used for forming a T-shaped corner of a wall structure and comprises two rectangular boards 20 and 21 extending parallel to each other, each having flat top and bottom edges, and connecting members 27 and 28 connecting these boards. The board 20 has V-shaped opposite edges 23 and 24. On the other hand, the other board 21 has only one V-shaped vertical edge 25, the other vertical edge 26 being flat. Here, the board 20 has a length about one third longer than that of the board 21, and the V-shaped vertical edges 24 and 25 are aligned to each other. A space 22 is defined by the boards 20 and 21 and connecting members 77 and 78. The connecting members 77 and 78 have a smaller height than the boards 20 and 21. Again here, the width of the inner slanted surface of each V-shaped vertical edge is desirably made greater than that of the outer surface.

The concrete block D shown in FIGS. 7 and 8, which is used for forming a corner of a T-shaped or a cross-shaped sectional profile, comprises two symmetrically arranged, rectangular boards 27 and 28 extending parallel to each other, each having a flat top and bottom edges, and connecting members 33 and 34 connecting these boards. The inner slanted surfaces of the edges 29, 30 are desirably larger than the outer slanted surfaces. The one vertical edges of the boards 27 and 28 are V-shaped, as shown at 29 and 30, while the other vertical edges are flat, as shown at 31 and 32. The connecting member 33 connects the boards at portions thereof adjacent to the respective V-shaped edges, while the connecting member 34 connects the boards at intermediate portions thereof, thus defining an inner space 35. These connecting members 33 and 34 have a height smaller than that of the boards.

FIGS. 9 and 10 show portions of some typical building structures formed by suitably combining some of the aforementioned concrete blocks A, B, C and D of different configurations.

In FIG. 9, two blocks B are first erected on a base (not shown) in the L-shaped form, with the edges 15 of the mating boards 11 in contact with each other and the edges 13 of the mating boards 10 in contact with each other. Then an L-shaped reinforcing bar 37 is horizontally arranged along the center of the L-shaped space 36 defined by the two blocks. Then, vertical reinforcing bars 38 are erected on both of the reinforcing bar 37 at end portions and a central portion of the space 34. Then, a rectangular reinforcing bars 39 are fitted to surround the vertical reinforcing bars 38. Thereafter, mortar is charged into the L-shaped space to embed and unite the reinforcing boards and loops. In this way, the L-shaped corner is formed. If necessary, covers 40 and 41 may be provided to cover the corner portions. Also, a block A is laid adjacent to each edge of the corner portion, with its edges 3 abutting with the mating edges 12 and 14 of the corner protion to define a space 42, and vertical reinforcing bars 38 are erected in the space 42 and embedded by charging mortar for forming a wall.

It will be seen that this structure is very strong and rigid since the contact area of charged mortar is increased due to the enlarged area of the inner space from the edges toward the central bent portion and the structure is protected against breakage and made more resistant to the shocks of earthquakes.

In the structure shown in FIG. 10, two blocks C shown in FIG. 5 are arranged end to end with their boards 20 abutting on the respective edges 23, and then a block D shown in FIG. 7 is laid with the edges 31 and 32 of the boards 27 and 28 in contact with the respective edges 26 of the boards 21 of the blocks C, thus forming a T-shaped space 44. Two horizontal reinforcing members 46 are laid on the connecting members 77 and 78 substantially along the center of the T-shaped space 44, and united together into a T-shape. Reinforcing bars 38 are erected vertically on both sides of the reinforcing member 46. Then, a reinforcing member consisting of a rectangular loop member 39 and a U-shaped member 47 tied thereto is fitted to surround the vertical reinforcing bars. Thereafter, mortar is charged into the whole space to embed and unit the reinforcing members. In this way, the T-shaped corner is formed. If necessary, covers 48 may be provided to cover the structure. A block A is laid adjacent to each edge of the T-shaped corner portion thus formed, with its edges 3 abutting with the mating edges 24 and 25 of the blocks C of the corner portion, and vertical reinforcing bars 38 are erected in the space 42 and embedded by charging mortar. In this way, a wall united to the corner portion is formed. A plurality of such wall structures are successively formed one above another to form a building.

EMBODIMENT 2

Sound insulating concrete blocks and building structures constructed from these blocks.

Sound insulating concrete blocks and a building structure employing them are shown in FIGS. 11 to 16.

Figure 13:
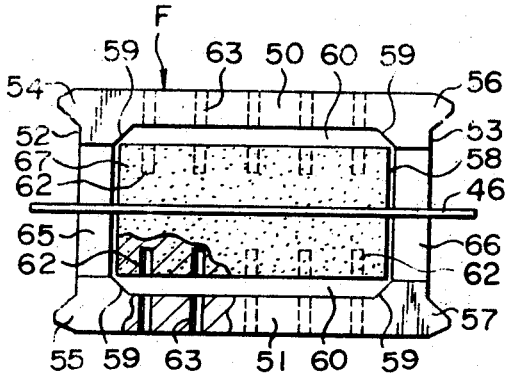
FIG. 13 is a plan view, partly broken away, showing a sound insulating block F with the opposite transversal walls formed with respective channel-shaped upper portions.
Figure 14:
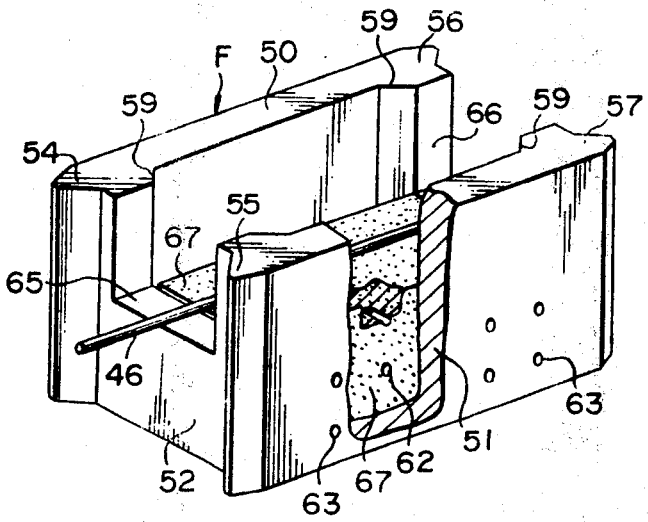
FIG. 14 is a perspective view, partly broken away, of the same.
Figure 15:
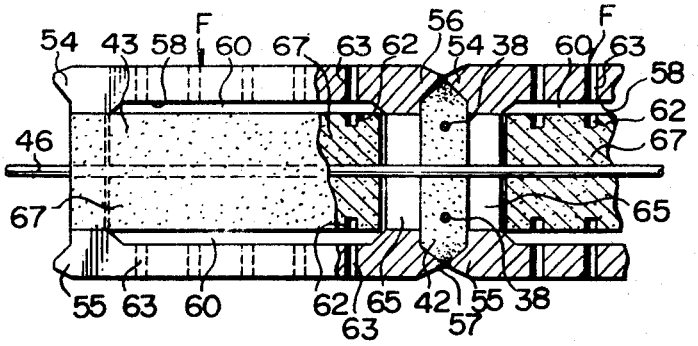
FIG. 15 is a plan view, partly broken away, showing partly of an embodiment of a block F.
Figure 16:
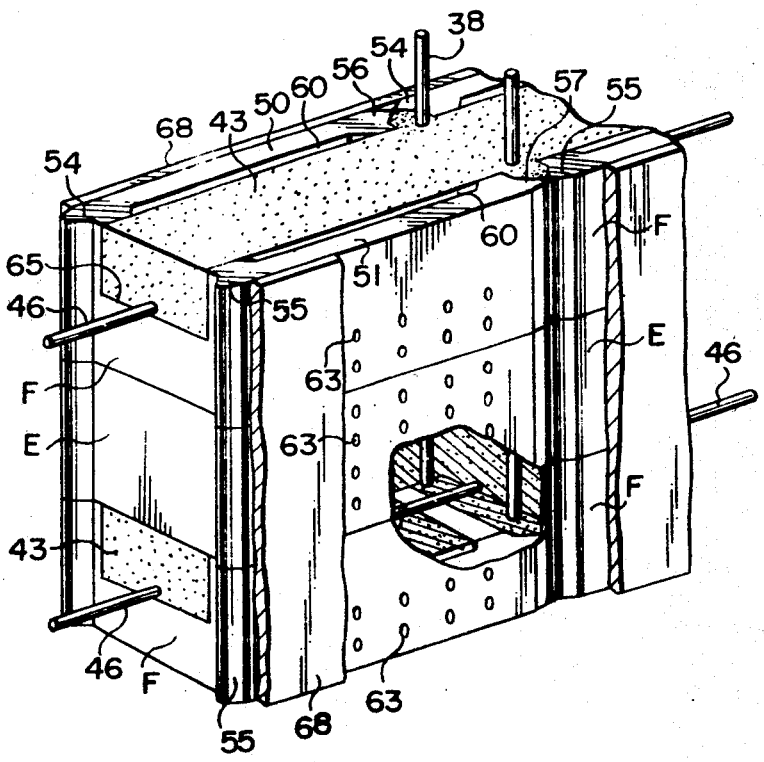
FIG. 16 is a perspective view showing a wall structure formed by stacking the blocks E and F one above another.

More particularly, FIGS. 11 to 14 show some sound insulating concrete blocks, and FIGS. 15 and 16 show a sound-proof building structure constructed by using such blocks. Here, two kinds of blocks are used, namely block E shown in FIGS. 11 and 12 and block F shown in FIGS. 13 and 14. The block E is a rectangular box-shaped block having a rectangular wall frame while the block F has a frame having opposite transversal walls formed with cut-outs at their upper portions.

Figure 11:
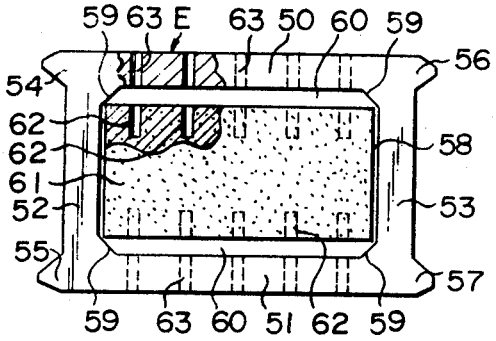
FIG. 11 is a plan view, partly broken away, showing a sound insulating block E.
Figure 12:
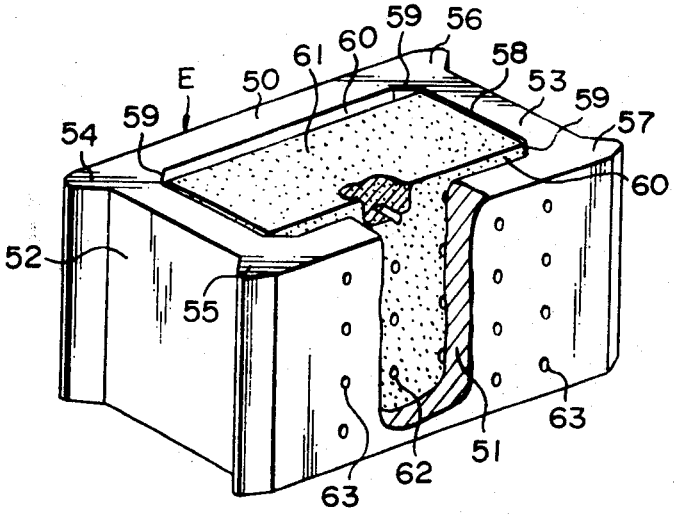
FIG. 12 is a perspective view, partly broken away, of the same.

The block E shown in FIGS. 11 and 12 has a rectangular box-shape and consists of four walls 50, 51, 52 and 53. The longitudinal wall 50 has V-shaped opposite vertical edges 54 and 55, and the other longitudinal wall 51 similarly has V-shaped opposite vertical edges 56 and 57. The width of the inner slanted surface of each V-shaped vertical edge may be equal to, but desirably greater than that of the outer slanted surface. With these edges, a vertically open space 42 as shown in FIG. 15 may be defined by abutting the two blocks. The block also has a vertically open, substantially rectangular inner space 58 having oblique corners defined by the respective oblique surface 59. A rectangular sound absorber 61 formed on its opposite sides with a number of lateral bores 62 is inserted in the space 58 for forming the gaps 60 defined on the opposite sides by the oblique surfaces 59. The sound absorber may be made of a compacted styrol foam resin or other materials suited to absorb sound. The opposite longitudinal walls 50 and 51 of the block frame are formed with through-holes 63 communicating with the aforesaid gaps 60 and arranged in a plurality of rows. The holes 63 are preferably alined to the respective bores 62 formed in the sound absorber 61. In some cases, only one longitudinal wall may be formed with through-holes, and in such case the sound absorber may be formed with through lateral bores.

The block F shown in FIGS. 13 and 14, similar to the previous block E, has a frame having a vertically open, substantially rectangular inner space 58 having oblique corners defined by respective oblique surfaces 59. Here, like portions are designated by like reference numerals. The transversal walls 52 and 53 in this frame, however, are channel-shaped, that is, they are formed with respective notches 65 and 66 in their upper portion, so that a horizontal reinforcing bar 46 may be placed on the bottom of these notches. The longitudinal walls 50 and 51 are formed in their lower portions with a number of through-holes 63 communicating with the inner space 58. Inserted in the space 58 is a sound absorber 67 with its top at the same level as the bottom of the notches 65 and 66 and defining gaps 60 on its opposite sides. The sound absorber 67 has a similar structure to that of the block E except that it has a smaller height and is provided with several rows of bores 62 to correspond to the through-holes 63 formed in the longitudinal walls 50 and 51, and the longitudinal walls thereof are provided with V-shaped vertical edges 54, 55, 56 and 57.

FIGS. 15 and 16 show a wall structure formed by employing the blocks E and F shown in FIGS. 11 to 14 in a specific combination. In forming this wall structure, blocks F are first laid in a row with the edges of adjacent blocks abutting with one another. Then, a suitable number of parallel horizontal reinforcing bars are passed through the individual notches, and vertical reinforcing bars 38 are erected in each vertical space 42 defined by transversal walls 52 and 53 facing each other and the abutted vertical edges. Then, mortar is charged in each vertical space 42 to embed the reinforcing members therein while leaving the gaps 60 empty. Thereafter, blocks E are stacked on the blocks F so as to surround the vertical reinforcing bars 38 within the individual vertical spaces at the junctures of the adjacent blocks, and they are united by charging mortar. In this way, the rows of blocks E and F are alternately stacked one above another. The V-shaped recesses on both sides of the wall structure are charged with mortar. If necessary, decorative outer fitting material 68 may be used.

Again this structure is very strong and rigid since the individual blocks are united by means of reinforcing members and mortar. Also, it has a sufficient sound insulation effect since sound waves entering through the holes 63 formed in the longitudinal walls into the inner gap 60 are re-directed there in random directions and absorbed through the bores 62 in the sound absorber 67. Also, this wall structure can reduce noise sound. Thus, this sound-proof wall structure is particularly effective for installation to shelter noise sound sources such as high-ways, noisy plants, construction sites, livestock pens and houses.

EMBODIMENT 3

Heat insulating concrete blocks and building structures constructed from these blocks FIGS. 17 to 20 show heat insulating concrete blocks.

Figure 17:
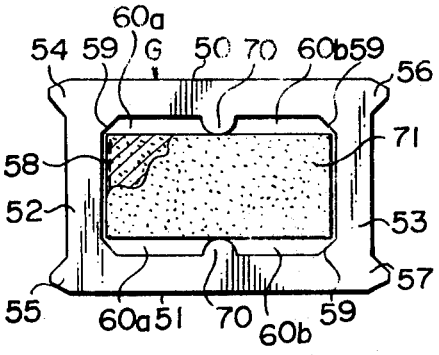
FIG. 17 is a plan view of a heat-insulating block G.
Figure 18:
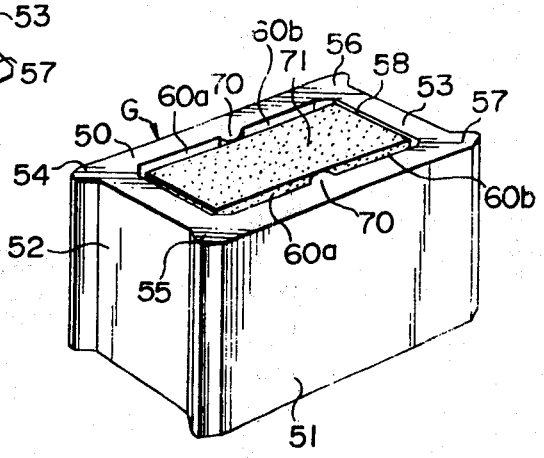
FIG. 18 is a perspective view of the same.
Figure 19:
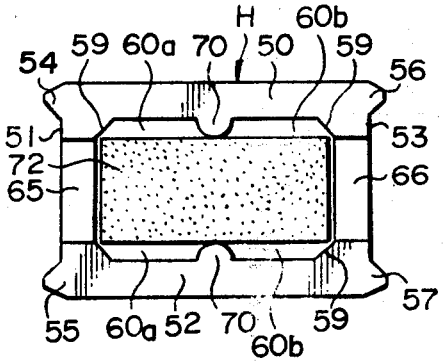
FIG. 19 is plan view of a heat-insulating block H with the transversal opposite walls formed with respective channel-shaped upper portions.
Figure 20:
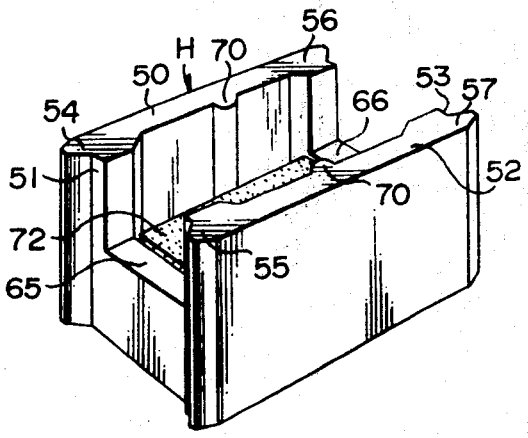
FIG. 20 is a perspective view of the same.

More particularly, FIGS. 17 and 18 show a concrete block G similar to the block E and FIGS. 19 and 20 show a block H similar to the block F in the preceding embodiments. Here, like portions are designated by like reference numerals and are not described. These blocks are different from the blocks in the preceding embodiment in that the longitudinal walls 50 and 51 are provided with respective integral vertical ridges 70, that no through-holes are formed in these walls and that heat insulators 71 and 72 accommodated in the inner space are formed with no bores. The vertical ridges 70 are provided for supporting the heat insulators 71 and 72, and they also serve to provide an increased number of gaps **60*a* and 60*b* so as to provide more effective heat insulation property. In the block H, the top of the hot insulator 72 is at substantially the same level as the bottom of the notches 65.** The blocks G and H may be stacked alternately as in the preceding embodiment or in any other suitable way. Also, they may be used in combination with the blocks in the preceding embodiments.

With a wall structure formed by using these heat insulating concrete blocks and having a heat insulator, the heat is conducted through the air retained within the inner communicating gaps. Thus, it can absorb heat from the outside, while sufficiently preventing the intrusion of rain and water droplets. With these blocks, uniform heat insulation can be obtained due to the heat insulating effect provided by the air layer in the inner gap and conduction of radiated heat, and with this ventilating effect the temperature and moisture in the room can be held substantially constant.

What is claimed is:

1. A building structure comprising (i) a plurality of contiguous concrete blocks spaced in an end to end relationship, said blocks comprising two rectangular side boards spaced from and extending parallel to each other, each said side board having at least one V-shaped vertical edge, said V-shaped edge abutting the V-shaped edge on an adjacent block, and connecting members integrally connecting said side boards wherein the side boards of at least one of said plurality of blocks are of different lengths and have respective V-shaped vertical edges aligned with each other and wherein the shorter side board has one flat vertical edge, the height of said connecting members being less than the height of said boards, such that the top of each of said connecting members is at a lower level than the top of each of said boards; (ii) horizontally extending reinforcing bars situated within the space between said side boards above the top of said connecting members; (iii) vertically extending reinforcing bars situated within the space formed by said side boards and said connecting members; (iv) reinforcing loops positioned in the space formed by said side boards and said connecting members and surrounding said vertically extending reinforcing bars; and (v) mortar in the spaces defined by said side boards and said connecting members and all of the grooves defined by said V-shaped edges, integrally uniting members (i) – (iv).

2. The structure of claim 1, wherein the longer of said boards has V-shaped opposite vertical edges.

3. A building structure comprising (i) a plurality of contiguous concrete blocks spaced in an end to end relationship, said blocks comprising two rectangular side boards spaced from and extending parallel to each other, each said side board having at least one V-shaped vertical edge, said V-shaped edge abutting the V-shaped edge on an adjacent block, and connecting members integrally connecting said side boards, the height of said connecting members being less than the height of said boards, such that the top of each of said connecting members is at a lower level than the top of each of said boards wherein the side boards of at least one of said plurality of blocks are of the same length and have respective V-shaped vertical edges and flat vertical edges aligned with each other and wherein both of said side boards extend a greater distance beyond one of said connecting members than they extend beyond the other of said connecting members; (ii) horizontally extending reinforcing bars situated within the space between said side boards above the top of said connecting members; (iii) vertically extending reinforcing bars situated within the space formed by said side boards and said connecting members; (iv) reinforcing loops positioned in the space formed by said side boards and said connecting members and surrounding said vertically extending reinforcing bars; and (v) mortar in the spaces defined by said side boards and said connecting members and all of the grooves defined by said V-shaped edges, integrally uniting members (i) – (iv).

4. A building structure comprising (i) a plurality of contiguus concrete blocks spaced in an end to end relationship, said blocks comprising a generally rectangular frame formed by two longitudinal walls and two transverse walls and having a substantially rectangular inner space with oblique corners formed therein, said longitudinal walls having V-shaped opposite vertical edges, which extend beyond the transverse walls and a plurality of holes therethrough, and a sound absorbing material positioned in said inner space wherein said oblique corners prevent said sound absorbing material from contacting said longitudinal walls; (ii) vertically extending reinforcing bars situated in the space defined by the V-shaped vertical edges and transverse walls of adjacent blocks; and (iii) mortar in the space defined by the V-shaped vertical edges and transverse walls of adjacent blocks and the grooves formed by the V-shaped vertical edge of adjacent blocks which face said space for integrally uniting (i) and (ii)

5. The structure of claim 4, wherein the transverse walls of at least one of said plurality of blocks have generally U-shaped notches extending down to substantially the vertical midpoint of the walls.

6. The structure of claim 5, which includes horizontally extending reinforcing bars situated within said U-shaped notches.

7. The structure of claim 4, wherein said sound absorbing material is provided with a plurality of bores aligned with the through holes of said longitudinal walls.

8. A building structure comprising (i) a plurality of contiguous concrete blocks spaced in an end to end relationship, said blocks comprising a generally rectangular frame formed by two longitudinal walls and two transverse walls and having a substantially rectangular inner space having oblique corners, said longitudinal walls having V-shaped opposite vertical edges, which extend beyond the transverse walls and having vertically extending ridges integrally formed thereon on the inner surface of said longitudinal walls, and a heat insulating material positioned in said inner space wherein said vertically extending ridges and oblique corners prevent said heat insulating material from contacting said longitudinal walls; (ii) vertically extending reinforcing bars situated in the space defined by the V-shaped vertical edges and transverse walls of adjacent blocks and (iii) mortar in the space defined by the V-shaped vertical edges and transverse walls of adjacent blocks and the grooves formed by the V-shaped vertical edge of adjacent blocks which face said space for integrally uniting (i) and (ii).

9. The structure of claim 8, wherein the transverse walls of at least one of said plurality of blocks have generally U-shaped notches extending down to substantially the vertical midpoint of the walls.

10. The structure of claim 9, which includes horizontally extending reinforcing bars situated within said U-shaped notches.

* * * * *